US011142420B2

(12) United States Patent
Tanizaki et al.

(10) Patent No.: US 11,142,420 B2
(45) Date of Patent: Oct. 12, 2021

(54) PRINTING DEVICE INCLUDING STOPPER FOR RESTRICTING MOVEMENT OF SHEET SUPPORTING PORTIONS

(71) Applicant: BROTHER KOGYO KABUSHIKI KAISHA, Nagoya (JP)

(72) Inventors: Masashi Tanizaki, Kuwana (JP); Yushi Kato, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 68 days.

(21) Appl. No.: 16/723,364

(22) Filed: Dec. 20, 2019

(65) Prior Publication Data

US 2020/0239260 A1 Jul. 30, 2020

(30) Foreign Application Priority Data

Jan. 24, 2019 (JP) ..... JP2019-010191

(51) Int. Cl.
*B65H 16/06* (2006.01)

(52) U.S. Cl.
CPC ..... *B65H 16/06* (2013.01)

(58) Field of Classification Search
CPC ..... B65H 16/06; B65H 2402/542; B65H 2403/411; B65H 2403/52; B65H 2511/12; B65H 2301/41346; B65H 2801/12; B65H 9/101; B65H 2301/3611; B65H 2301/36212; B65H 2403/46; B65H 19/126; B65H 2301/41342; B41J 15/04; B41J 15/046
USPC ..... 242/578.1
See application file for complete search history.

(56) References Cited

U.S. PATENT DOCUMENTS 5,813,343 A * 9/1998 Harb ..... B65H 16/06 101/212
6,158,342 A * 12/2000 Moore ..... B41J 11/0045 101/407.1
6,431,492 B1 * 8/2002 Chillscyzn ..... B41J 15/042 242/577
8,925,854 B2 * 1/2015 Chen ..... B65H 16/06 242/578.1
10,807,390 B2 * 10/2020 Harris ..... B65H 16/06
(Continued)

FOREIGN PATENT DOCUMENTS

JP 2003-146493 A 5/2003

*Primary Examiner* — William A. Rivera
(74) *Attorney, Agent, or Firm* — Kenealy Vaidya LLP

(57) ABSTRACT

A printing device includes a holder including: a first movable portion including a first support portion; a second movable portion including a second support portion; a pinion; a spring; an adjustment screw; a handle rotatable with the adjustment screw; and a stopper threadingly engaged with the adjustment screw. The first movable portion is movable in a first direction and a second direction opposite the first direction. The second movable portion is movable in the first direction and the second direction in accordance with movement of the first movable portion in the second direction and the first direction. The handle is positioned outside of a region defined between the first and second support portions positioned remotest from each other in the first direction. The stopper is in abutment with one of the first and second movable portions to restrict movements of the first and second movable portions.

15 Claims, 9 Drawing Sheets

(56) References Cited

U.S. PATENT DOCUMENTS

| | | | | |
|---|---|---|---|---|
| 2002/0175985 | A1* | 11/2002 | Zevin | B41J 15/02 347/104 |
| 2003/0141655 | A1* | 7/2003 | Bryer | B65H 9/101 271/264 |
| 2003/0159603 | A1* | 8/2003 | Lee | B41J 3/4075 101/228 |
| 2010/0061790 | A1* | 3/2010 | Yu | B41J 15/042 400/613 |
| 2012/0182369 | A1* | 7/2012 | Kokuta | B41J 15/02 347/217 |
| 2016/0221777 | A1* | 8/2016 | Morikami | B65H 1/04 |
| 2019/0030928 | A1* | 1/2019 | Kanda | B65H 16/06 |
| 2019/0127170 | A1* | 5/2019 | Harris | B65H 75/08 |
| 2019/0135000 | A1* | 5/2019 | Harris | B65H 19/126 |
| 2019/0366737 | A1* | 12/2019 | Kato | B41J 15/042 |
| 2021/0060985 | A1* | 3/2021 | Kato | B41J 15/02 |

* cited by examiner

PRINTING DEVICE INCLUDING STOPPER FOR RESTRICTING MOVEMENT OF SHEET SUPPORTING PORTIONS

CROSS REFERENCE TO RELATED APPLICATION

This application claims priority from Japanese Patent Application No. 2019-010191 filed Jan. 24, 2019. The entire content of the priority application is incorporated herein by reference.

TECHNICAL FIELD

The present disclosure relates to a printing device.

BACKGROUND

There has been conventionally known a printing device including a fixing member and a pair of support portions configured to hold a paper roll (see Japanese Patent Application Publication No. 2003-146493, for example). The pair of support portions is interlockingly movable toward and away from each other. The fixing member is provided at one of the support portions to regulate or restrict movement of the pair of support portions. A user moves the pair of support portions for positional adjustment thereof so as to conform with a width of the paper roll, and then, the user operates the fixing member to fix the position of the pair of support portions.

SUMMARY

Such conventional printing device is bulky due to provision of the fixing member at one of the support portions.

In view of the foregoing, it is an object of the disclosure to provide a compact printing device including: a pair of support portions interlockingly movable toward and away from each other; and a fixing member to restrict movement of the pair of support portions.

In order to attain the above and other objects, according to one aspect, the disclosure provides a printing device including a holder configured to hold a printing medium. The holder includes: a first movable portion, a second movable portion, a pinion, a spring, an adjustment screw, a handle, and a stopper. The first movable portion includes: a first slider formed with a first rack; and a first support portion connected to the first slider. The second movable portion includes: a second slider formed with a second rack portion; and a second support portion connected to the second slider. The second support portion is configured to support the printing medium in cooperation with the first support portion. The pinion is in meshing engagement with each of the first rack and the second rack. The first movable portion is movable in a first direction and in a second direction opposite to the first direction. The second movable portion is movable in the first direction in accordance with movement of the first movable portion in the second direction, and the second movable portion is movable in the second direction in accordance with movement of the first movable portion in the first direction. The spring is configured to apply an urging force such that the first movable portion and the second movable portion approach each other. The adjustment screw extends in the first direction and is rotatable about an axis extending in the first direction. The handle is rotatable together with the adjustment screw about the axis. The handle is positioned outside of a region defined between the first support portion and the second support portion in the first direction in a state where the first support portion and the second support portion are positioned remotest from each other. The stopper is threadingly engaged with the adjustment screw and is movable in the first direction and in the second direction in accordance with rotation of the adjustment screw caused by rotational operation to the handle. The stopper is configured to abut against one of the first movable portion and the second movable portion to restrict movements of the first movable portion and the second movable portion.

DETAILED DESCRIPTION

Hereinafter, a printing device 1 according to one embodiment of the disclosure will be described with reference to FIG. 1 through 10.

Figure 1:
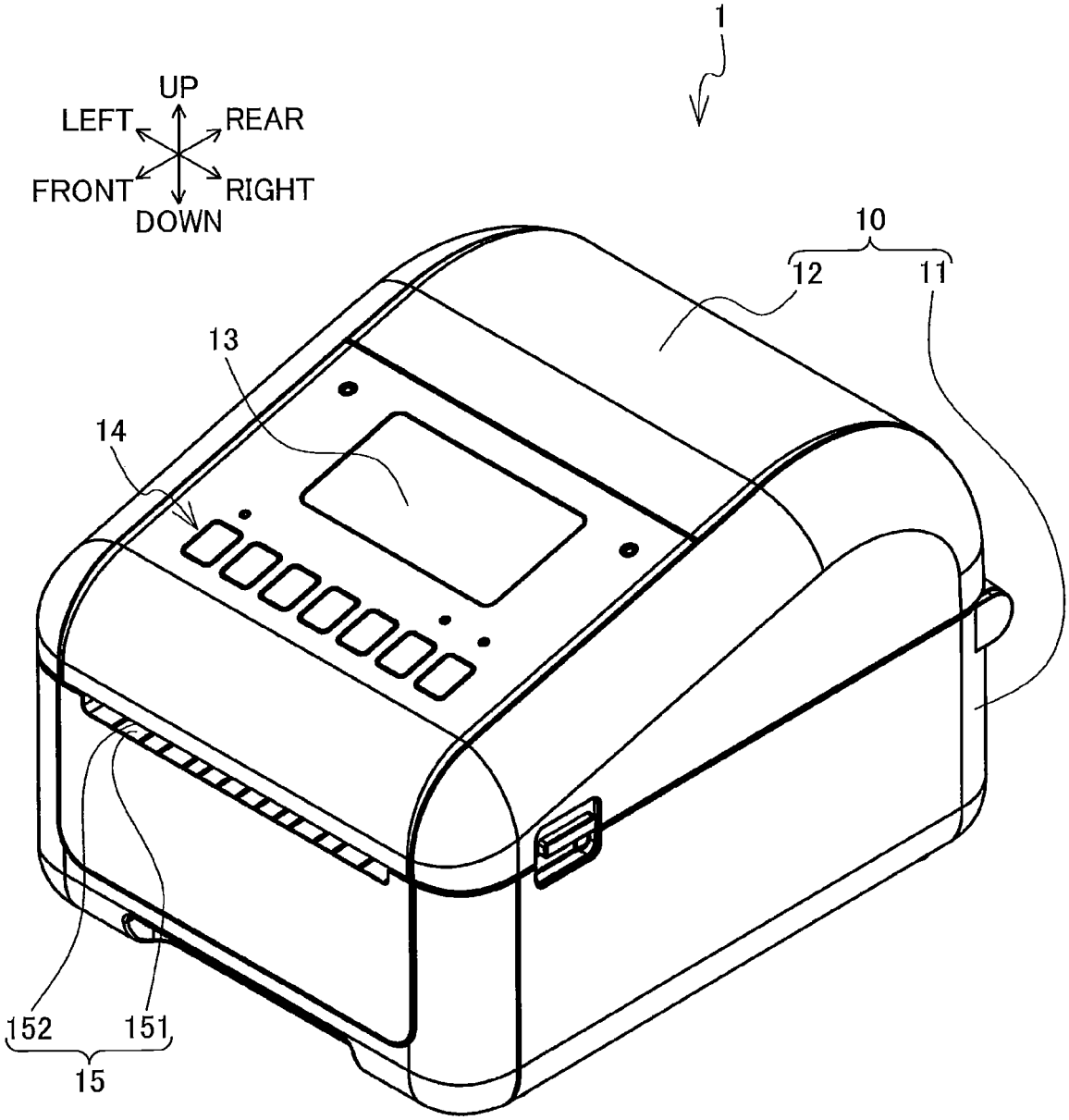
FIG. 1 is a perspective view of a printing device according to one embodiment in a closed state of a cover relative to a main body portion.

In the following description, directions in relation to the printing device 1 will be used assuming that the printing device 1 is in an orientation illustrated in FIG. 1. Specifically, a diagonally lower rightward direction, a diagonally upper leftward direction, a diagonally upper rightward direction, a diagonally lower leftward direction, an upward direction, and a downward direction depicted in FIG. 1 will be referred to as a rightward direction, a leftward direction, a rearward direction, a frontward direction, an upward direction, and a downward direction, respectively.

1. Overall Structure of the Printing Device 1

The printing device 1 is configured to receive printing data from an external device (not illustrated), such as a personal computer terminal, and to perform printing on a printing medium based on the received printing data. A heat-sensitive label is an example of such a printing medium. As illustrated in the FIGS. 1 through 3, the printing device 1 includes a housing 10. The housing 10 has a shape of generally rectangular parallelepiped, and includes a main body portion 11, a cover 12, and a discharge portion 15, and an opening 16.

The main body portion 11 and the cover 12 are formed of a resin material. The discharge portion 15 is in a form of a slit through which the printing medium on which an image has been recorded inside the printing device 1 is discharged to an outside of the printing device 1. The discharge portion 15 extends in a leftward/rightward direction. The discharge portion 15 is constituted by a lower discharge portion 151 positioned at a front end portion of the main body portion 11, and an upper discharge portion 152 positioned at a front end portion of the cover 12.

The opening 16 extends in the leftward/rightward direction so as to allow the printing medium positioned outside of the housing 10 to be fed into an interior of the housing 10. Specifically, the printing medium is fed, through the opening 16, into a portion between a first support portion 30 and a second support portion 40 inside the housing 10. The opening 16 is rectangular in shape and is formed at a rear end portion of the main body portion 11 (specifically, in a rear end portion of a main body cover 20 described later). The opening 16 has an extending range R1 (FIG. 3) in the leftward/rightward direction substantially equal to an extending range of the discharge portion 15.

Figure 2:
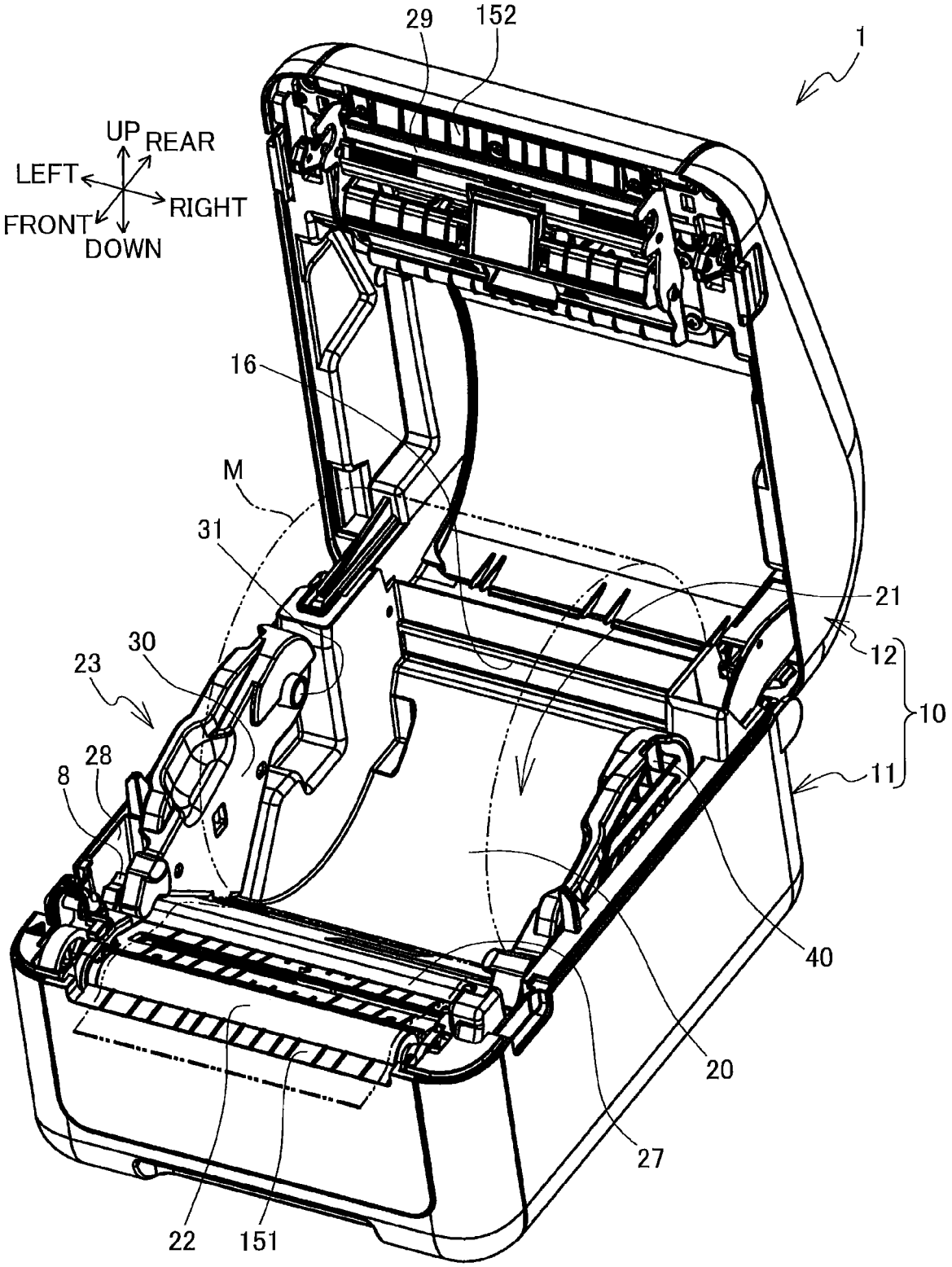
FIG. 2 is a perspective view of the printing device according to the embodiment in an opened state of the cover relative to the main body portion.
Figure 3:
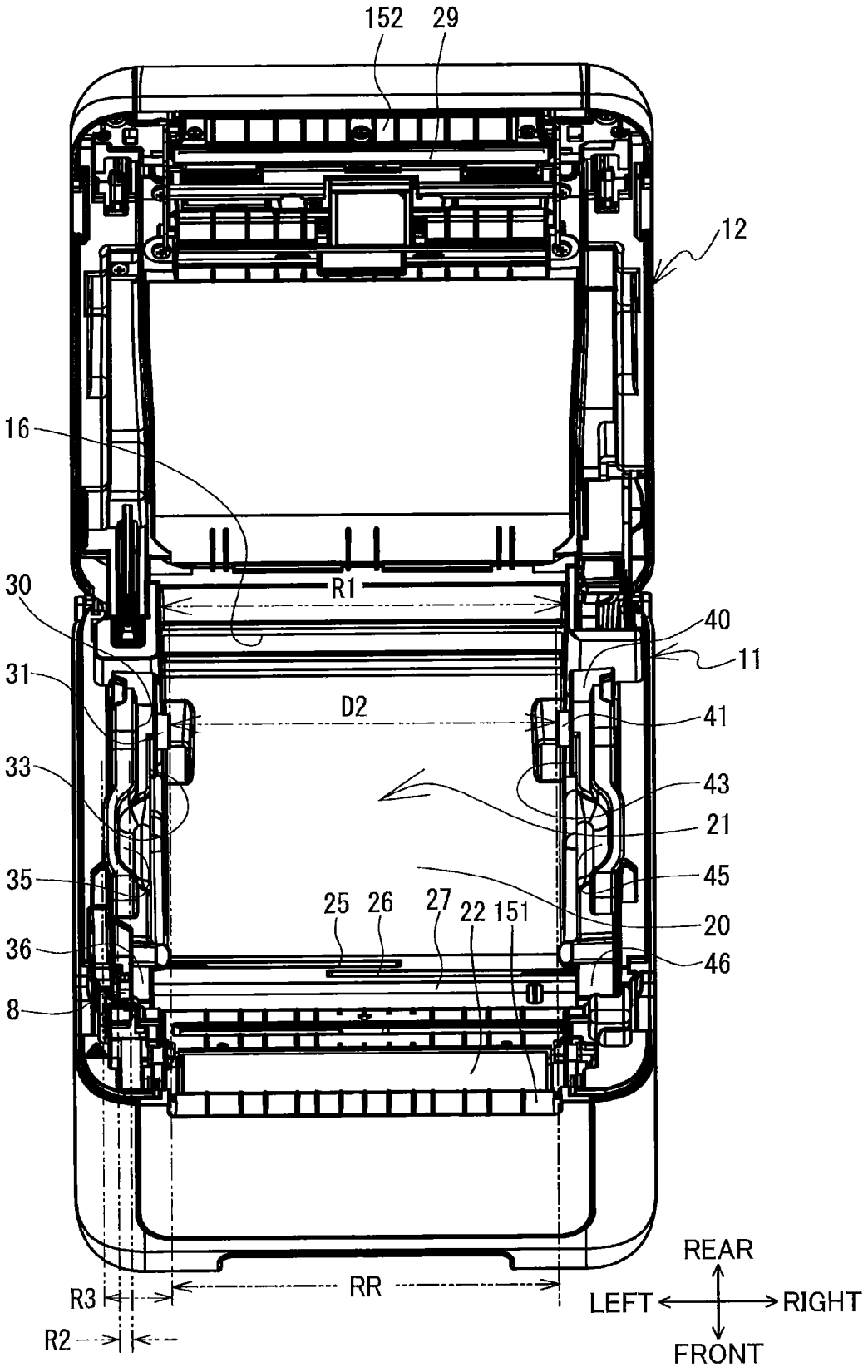
FIG. 3 is another perspective view of the printing device according to the embodiment in the opened state of the cover relative to the main body portion.
Figure 4:
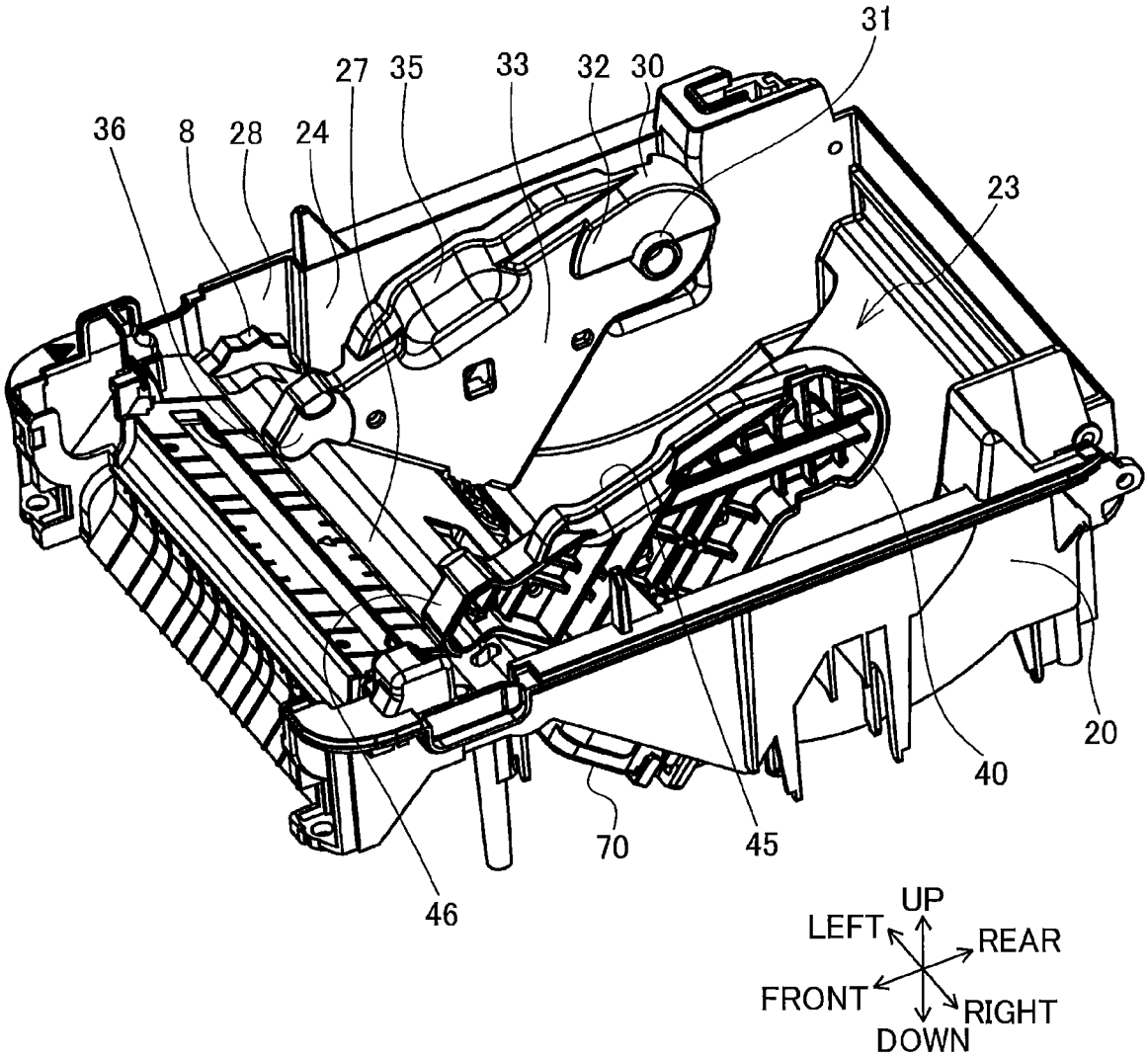
FIG. 4 is a perspective view illustrating a main body cover and a roll support mechanism in the printing device according to the embodiment.

The main body portion 11 has a generally rectangular parallelepiped box-like shape. The main body portion 11 constitutes a lower portion of the printing device 1. The main body portion 11 includes the main body cover 20, an accommodating portion 21, a platen roller 22, and a holder 23. As illustrated in FIGS. 2 through 4, the main body cover 20 is a box-like member having an open upper end. The main body cover 20 has a bottom wall whose rear portion is curved downward to form an arcuate shape in a side view. The bottom wall of the main body cover 20 has guide slots 25 and 26, recessed portions 27, 28, and the lower discharge portion 151.

The guide slots 25 and 26 are through-holes having a rectangular shape that extends in the leftward/rightward direction. The guide slots 25 and 26 are positioned between the recessed portion 27 and a lowermost portion of the bottom wall of the main body cover 20 in a frontward/rearward direction. The guide slot 25 allows a connecting portion 34 of the first support portion 30 (described later) to extend therethrough, and the guide slot 26 allows a connecting portion 44 of the second support portion 40 (described later) to extend therethrough. The guide slot 25 extends toward the left from a position rightward of a left-right center of the main body cover 20. The guide slot 26 extends toward the right from a position leftward of the left-right center of the main body cover 20. The guide slot 25 and guide slot 26 oppose each other in the frontward/rearward direction in a region near the left-right center of the main body cover 20 (center of the printing device 1). The guide slot 26 is positioned frontward of the guide slot 25.

The recessed portion 27 is provided at a position frontward of the guide slots 25 and 26 and rearward of the platen roller 22 (described later). The recessed portion 27 is recessed downward and extends in the leftward/rightward direction. The recessed portion 28 is provided at a front portion of a left side wall 24 constituting the main body cover 20. The recessed portion 28 is recessed leftward. The lower discharge portion 151 is positioned at a front end portion of the main body cover 20 and constitutes a lower portion of the discharge portion 15.

As illustrated in FIG. 2, the accommodating portion 21 is an interior space of the printing device 1 and defined by the main body cover 20. The bottom wall of the main body cover 20 defines a bottom of the accommodating portion 21. The accommodating portion 21 is configured to accommodate therein a sheet roll M with a core tube of the sheet roll M oriented in the leftward/rightward direction. The sheet roll M is constituted by a sheet (a heat-sensitive label affixed to a base sheet) wound over the core tube having a hollow cylindrical shape. The accommodating portion 21 is positioned between the discharge portion 15 and the opening 16 in the frontward/rearward direction.

The platen roller 22 is columnar in shape and is configured to convey the printing medium. The platen roller 22 extends in a longitudinal direction of the discharge portion 15 (the leftward/rightward direction) alongside the lower discharge portion 151. The holder 23 is configured to detachably support the sheet roll M. Details of the holder 23 will be described later. Although not illustrated, an electronic circuit board and the like are provided in the main body portion 11 below the main body cover 20. The electronic circuit board is configured to control operations performed in the printing device 1.

The cover 12 is pivotally movable between a closed state and an opened state about an axis extending in the leftward/rightward direction and positioned at an upper-rear portion of the main body portion 11. As illustrated in FIG. 1, in the closed state of the cover 12, an upper surface of the cover 12 slopes downward toward the front. The printing device 1 also includes a display 13 and an operating portion 14 on the upper surface of the cover 12. In the closed state of the cover 12, the operating portion 14 functions as an interface for inputting various instructions to the printing device 1.

As illustrated in FIG. 2, the cover 12 accommodates therein a thermal head 29. The thermal head 29 is positioned rearward of the upper discharge portion 152 to extend in the leftward/rightward direction. The thermal head 29 includes a plurality of heating elements aligned with one another in the leftward/rightward direction. The thermal head 29 is configured to be controlled by the above-mentioned electronic circuit board and to print characters or images on the heat-sensitive label upon application of heat. The cover 12 also includes the upper discharge portion 152. The upper discharge portion 152 is provided at the front end portion of the cover 12 to constitute an upper portion of the discharge portion 15.

2. Structure of the Holder 23

Details of the holder 23 will be described next with reference to FIGS. 2 through 10.

The holder 23 includes a support plate portion 70, a pinion 2, a first movable portion 3, a second movable portion 4, springs 5 and 6, an adjustment screw 7, a handle 8, a stopper 9, and a detector 90. The first movable portion 3 includes the first support portion 30, and the second movable portion 4 includes the second support portion 40. Hereinafter, a moving direction of the first support portion 30 and the second support portion 40 (i.e., the leftward direction or the rightward direction) may be referred to as a "first direction" collectively, wherever appropriate.

As illustrated in FIGS. 4 through 9, the support plate portion 70 is a plate-like member extending in the first direction. The support plate portion 70 is positioned below other components of the holder 23. The support plate portion 70 includes a boss 75, and grooves 76, 78, 79 extending in the first direction. The boss 75 is hollow cylindrical and is provided at a center portion of the support plate portion 70 to protrude upward therefrom. The boss 70 is positioned below the bottom wall of the main body cover 20, and between the guide slots 25 and 26 in the frontward/rearward direction.

The groove 76 is positioned at a front end portion of the support plate portion 70 to extend in the leftward/rightward direction. The grooves 78 and 79 are positioned rearward of the groove 76 and below the guide slots 25 and 26 formed in the bottom wall of the main body cover 20. The grooves 78, 79 have extending ranges in the leftward/rightward direction each greater than an extending range of the groove 76.

The pinion 2 is a spur gear formed with a through-hole at a radial center thereof. The through-hole penetrates through the radial center of the pinion 2 in an upward/downward direction. The boss 75 extends through the through-hole of the pinion 2, so that the pinion 2 is rotatably fitted with the boss 75. That is, the pinion 2 is rotatably supported by the boss 25. A rotation axis of the pinion 2 extends generally perpendicular to the bottom wall of the main body cover 20. The rotation axis of the pinion 2 is positioned at a center between the first support portion 30 and the second support portion 40 in the first direction. A screw 74 is threadingly engaged with the boss 75 so that the pinion 2 is supported immovably in an extending direction of the rotation axis thereof.

As illustrated in FIGS. 2 through 5, the first movable portion 3 includes a first slider 39, and the first movable portion 30. The first slider 39 extends in the first direction and is positioned rearward of the pinion 2. That is, the first slider 39 is positioned beside the pinion 2 in a direction perpendicular to the first direction. The first slider 39 is placed in the groove 78. The first slider 39 has a rectangular shape elongated in the leftward/rightward direction (first direction) in a plan view. The first slider 39 has a front end portion formed with gear teeth arranged in line in the leftward/rightward direction. These gear teeth constitute a toothed portion 390 of the first slider 39. The toothed portion 390 of the first slider 39 is in meshing engagement with the pinion 2. The first slider 39 is positioned below the bottom wall of the main body cover 20 and extends in a direction generally parallel to the bottom wall of the main body cover 20.

The first support portion 30 extends in a direction crossing the first slider 39. The first support portion 30 is a plate-like member having a generally right-angled triangular shape in a side view. The first support portion 30 includes a protrusion 31, a sector portion 32, the connecting portion 34, a recessed portion 35, and a protruding portion 36. The first support portion 30 also has a confronting surface 33, which is a surface opposing the second support portion 40 in the leftward/rightward direction.

The protrusion 31 has a frusto-conical shape protruding toward the second support portion 40 from a center portion of a rear end portion of the confronting surface 33. The sector portion 32 extends radially outward from an upper half region of a peripheral surface of the protrusion 31, and protrudes toward the second support portion 40 from the confronting surface 33. The protrusion 31 protrudes from the confronting surface 33 toward the second support portion 40 by a protruding length that is greater than a protruding length by which the sector portion 32 protrudes from the confronting surface 33.

Figure 10:
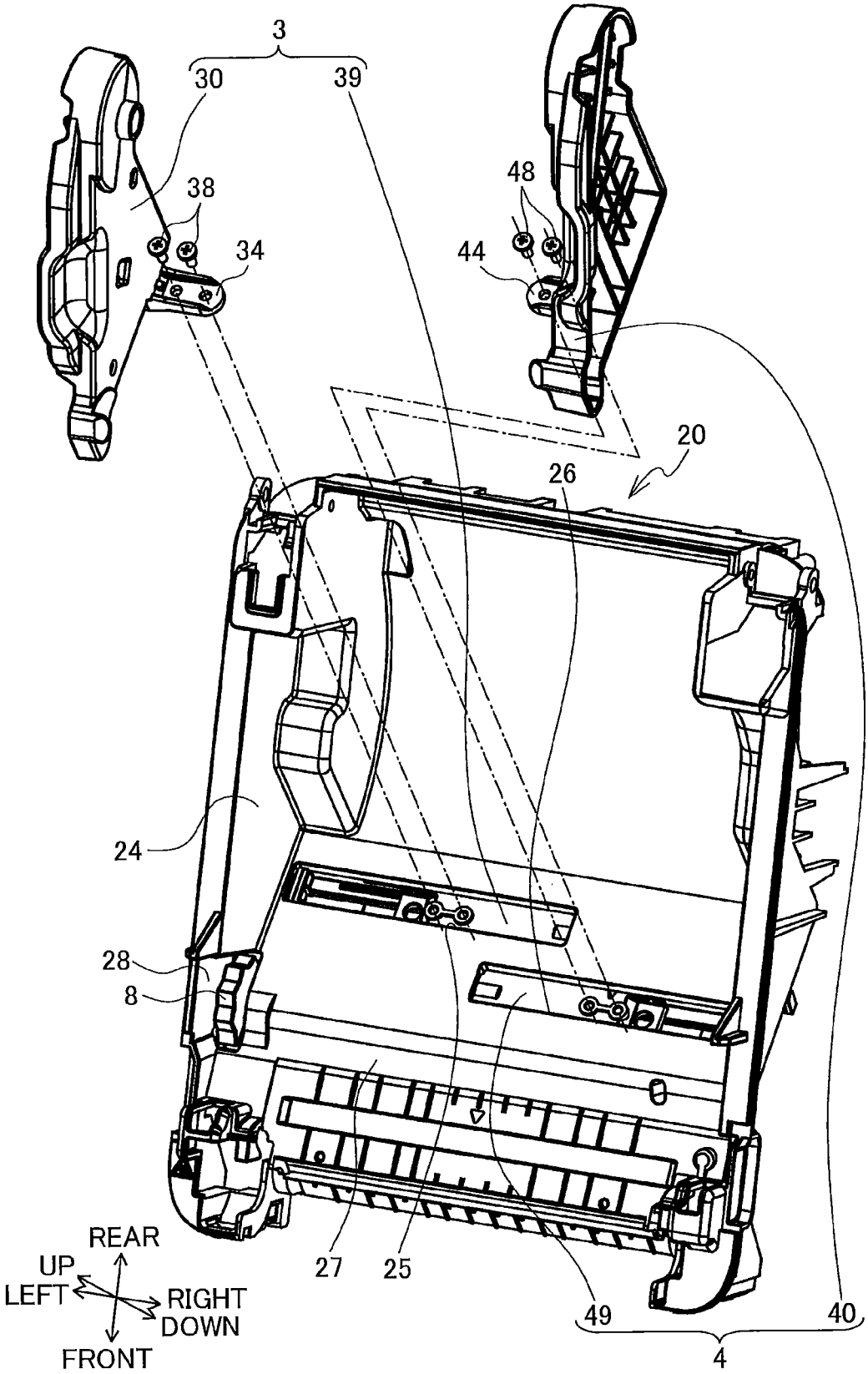
FIG. 10 is a view for description of a process for assembling a first support portion and a second support portion to the main body cover in the printing device according to the embodiment.

As illustrated in FIG. 10, the connecting portion 34 is a plate-like member extending toward the second support member 40 from a lower end portion of the confronting surface 33. The connecting portion 34 is formed with through-holes allowing screws 38 to extend therethrough. The first support portion 30 is fixed to the first slider 39 by the screws 38 penetrating through the through-holes in a state where the connecting portion 34 is inserted in the guide slot 25 formed in the bottom wall of the main body cover 20.

The recessed portion 35 is positioned at a hypotenuse of the right-angled triangular shape of the first support portion 30. The recessed portion 35 is recessed in a direction away from the second support portion 40 with respect to the leftward/rightward direction. The protruding portion 36 constitutes a front end portion of the first support portion 30 and protrudes downward. The protruding portion 36 is fitted with the recessed portion 27 formed in the bottom wall of the main body cover 20. With this structure, movement of the first support portion 30 in the leftward/rightward direction is configured to guided by the guide slot 25 and the recessed portion 27 of the main body cover 20.

As illustrated in FIGS. 2 through 5, the second movable portion 4 is movable in a direction opposite to the moving direction of the first support portion 30 (first direction) in interlocking relation with the movement of the first support portion 30. The second movable portion 4 includes a second slider 49 and the second support portion 40.

The second slider 49 extends in the first direction and is positioned frontward of the pinion 2. The second slider 49 is positioned opposite to the first slider 39 with respect to the pinion 2. The second slider 49 is arranged in the groove 79. The second slider 49 has a rectangular shape elongated in the leftward/rightward direction in a plan view. The second slider 49 has a rear end portion formed with gear teeth aligned with one another in the leftward/rightward direction. The gear teeth constitute a toothed portion 490 of the second slider 49. The toothed portion 490 of the second slider 49 is in meshing engagement with the pinion 2. The second slider 49 is positioned below the bottom wall of the main body cover 20 and extends in a direction substantially parallel to the bottom wall of the main body cover 20.

The pinion 2, the first slider 39, and the second slider 49 are positioned on a same datum plane. The second slider 49 has a front nearer left portion provided with a protrusion 47. The protrusion 47 protrudes frontward and upward.

The second support portion 40 extends in a direction crossing the second slider 49. The second support portion 40 is in confrontation with the first support portion 30 in the leftward/rightward direction. The second support portion 40 is a plate-like member having a generally right-angled triangular shape in a side view. The second support portion 40 is generally bilaterally symmetric with the first support portion 30. The second support portion 40 is movable in the first direction, and is configured to detachably support the sheet roll M in cooperation with the first support portion 30. The second slider 49 faces the first slider 39 in the frontward/rearward direction with the pinion 2 interposed therebetween.

The second support portion 40 includes a protrusion 41, a sector portion 42, the connecting portion 44, a recessed portion 45, and a protruding portion 46. The second support portion 40 also has a confronting surface 43, which is a surface in confrontation with the first support portion 30 in the leftward/rightward direction.

The protrusion 41 has a frusto-conical shape protruding toward the first support portion 30 from a center portion of a rear end portion of the confronting surface 43. The protrusion 41 is arranged at a position opposing the protrusion 31 in the leftward/rightward direction. The protrusions 41 and 31 are fittable with a hole of the core tube of the sheet roll M for supporting the sheet roll M.

The sector portion 42 extends radially outward from an upper half region of a peripheral surface of the protrusion 41, and protrudes toward the first support portion 30 from the confronting surface 43. The protrusion 41 protrudes from the confronting surface 43 toward the first support portion 30 (leftward) by a protruding length that is greater than a protruding length by which the sector portion 42 protrudes from the confronting surface 43. Further, the protruding length of the protrusion 41 from the sector portion 42 in the first direction is equal to the protruding length of the protrusion 31 from the sector portion 32 in the first direction.

The connecting portion 44 is a plate-like member extending toward the first support member 30 (leftward) from a lower end portion of the confronting surface 43. The connecting portion 44 is positioned frontward relative to the connecting portion 34. As illustrated in FIG. 10, the connecting portion 44 is formed with through-holes allowing screws 48 to extend therethrough. The second support portion 40 is fixed to the second slider 49 by the screws 48 extending through the through-holes in a state where the connecting portion 44 is inserted in the guide slot 26 formed in the bottom wall of the main body cover 20.

The recessed portion 45 is positioned at a hypotenuse of the right-angled triangular shape of the second support portion 40. The recessed portion 45 is recessed rightward (in a direction away from the first support portion 30). The recessed portion 45 is positioned to oppose the recessed portion 35 in the leftward/rightward direction.

The protruding portion 46 constitutes a front end portion of the second support portion 40 and protrudes downward. The protruding portion 46 is fitted with the recessed portion 27 formed in the bottom wall of the main body cover 20. With this structure, movement of the second support portion 40 in the leftward/rightward direction is guided by the guide slot 26 and the recessed portion 27 of the main body cover 20.

In accordance with leftward movement of the first support portion 30 by a predetermined amount, the second support portion 40 moves rightward by the same predetermined amount through the first slider 39, the pinion 2, and the second slider 49. Likewise, in accordance with rightward movement of the first support portion 30 by a predetermined amount, the second support portion 40 moves leftward by the same predetermined amount through the first slider 39, the pinion 2, and the second slider 49. In this way, the first support portion 30 and the second support portion 40 are interlockingly movable in opposite directions from each other. In other words, the first support portion 30 and the second support portion 40 are interlockingly movable in directions toward and away from each other.

Figure 5:
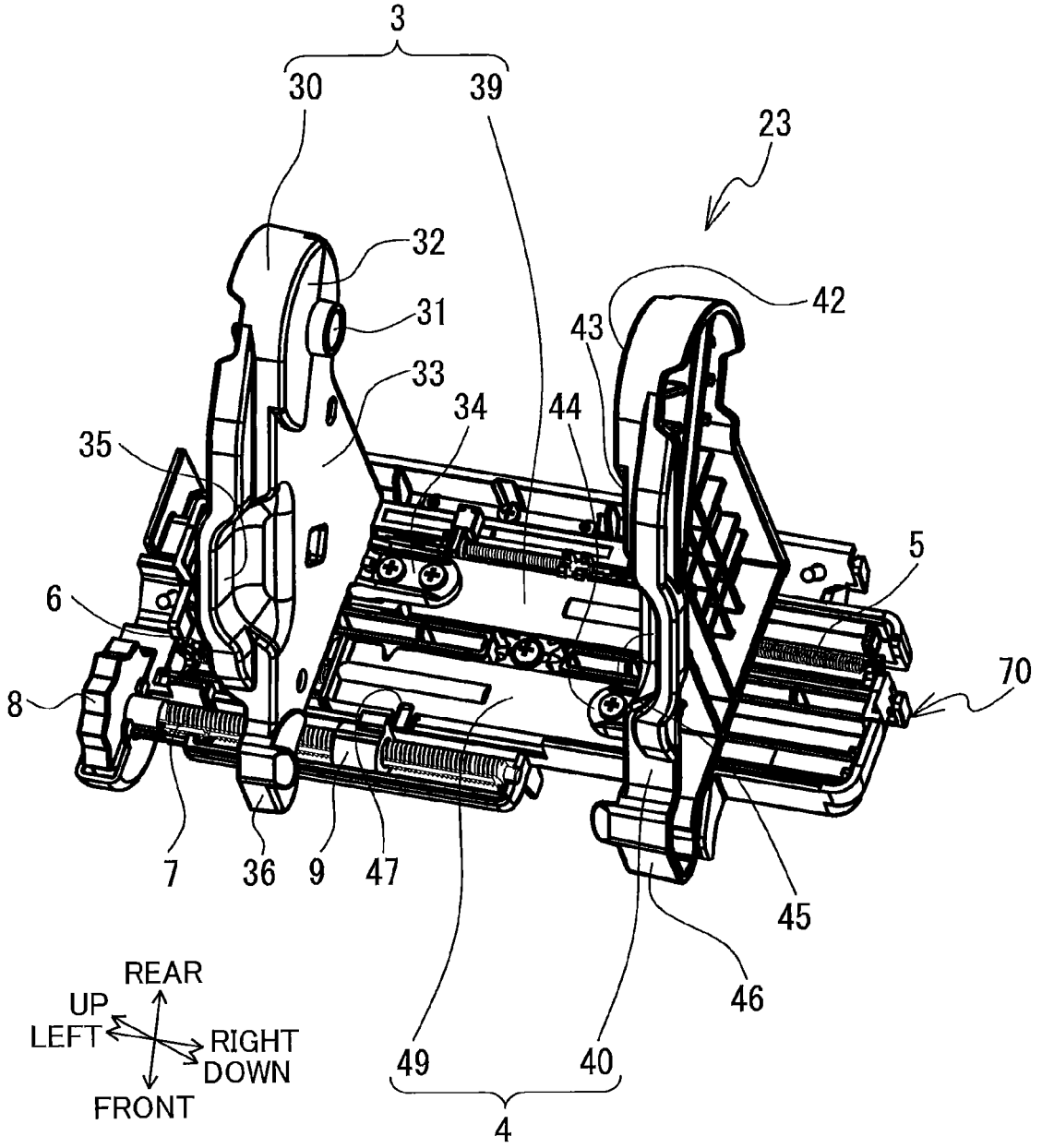
FIG. 5 is a perspective view of the roll support mechanism in the printing device according to the embodiment.
Figure 6:
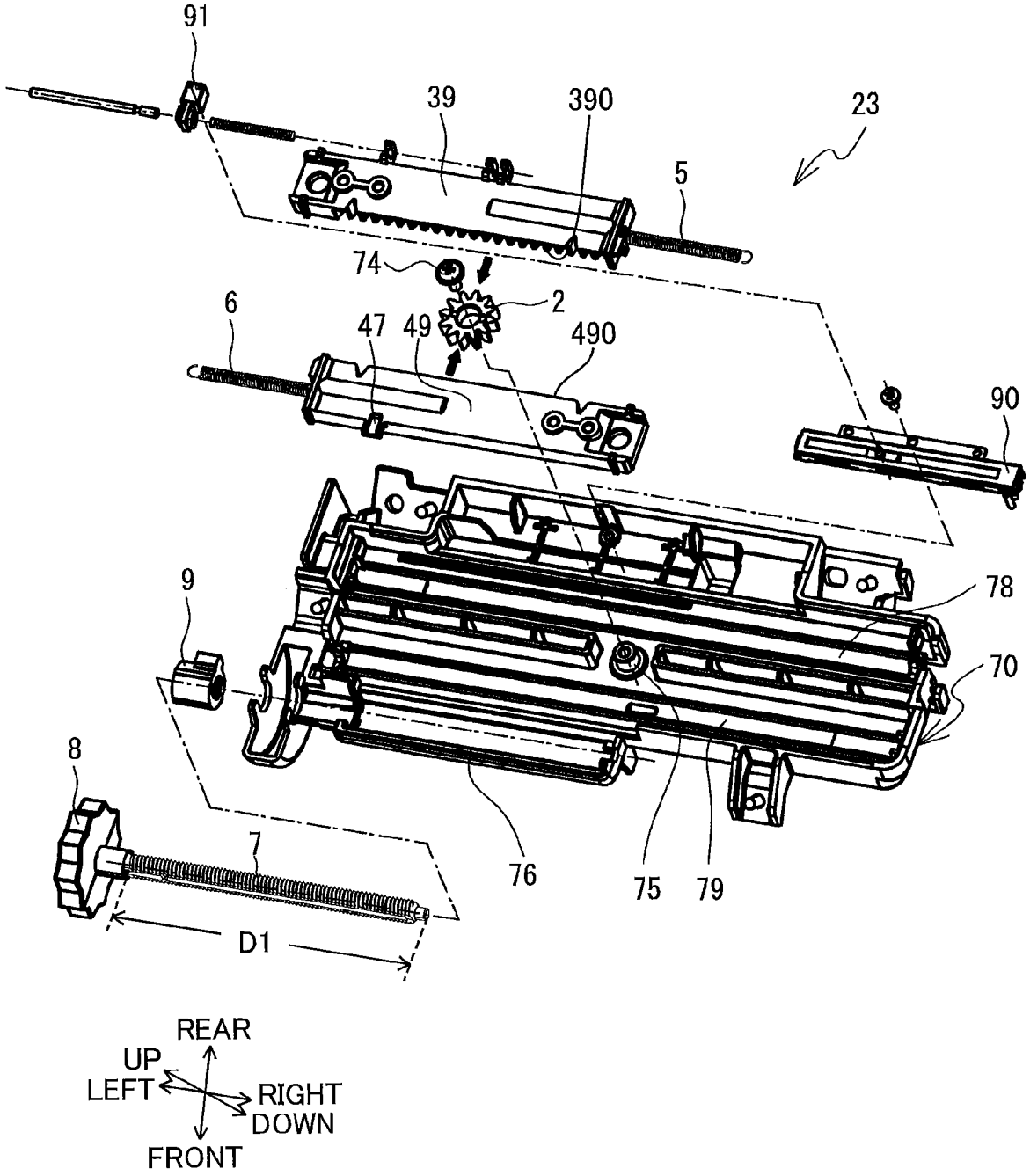
FIG. 6 is an exploded perspective view of the roll support mechanism in the printing device according to the embodiment.

As illustrated in FIGS. 5 and 6, the springs 5 and 6 urge the first movable portion 3 and the second movable portion 4, respectively, in directions approaching each other. The springs 5, 6 are, for example, tension springs. Specifically, the spring 5 is arranged in the groove 78 of the support plate portion 70, and the spring 6 is arranged in the groove 79 of the support plate portion 70. The spring 5 has a right end portion engaged with the support plate portion 70, and a left end portion engaged with a lower end portion of the first support portion 30. The spring 6 has a left end portion engaged with the support plate portion 70, and a right end portion engaged with a lower end portion of the second support portion 40. Hence, the first support portion 30 and the second support portion 40 are urged to approach each other by the springs 5 and 6.

Incidentally, the springs 5, 6 may pull or push the first movable portion 3 and the second movable portion 4, respectively, to apply such urging forces that the first support portion 30 and the second support portion 40 approach each other in the leftward or rightward direction.

Figure 7:
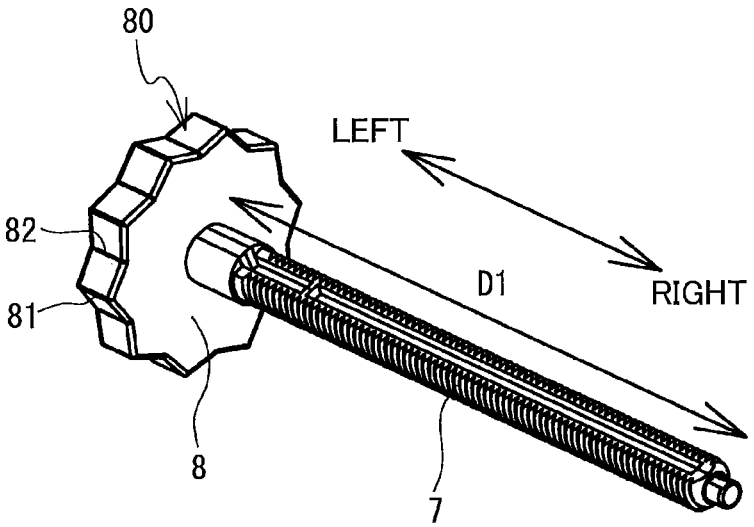
FIG. 7 is a perspective view illustrating an adjustment screw and a handle in the printing device according to the embodiment.

As illustrated in FIGS. 5 through 7, the adjustment screw 7 extends in the first direction, and is supported rotatably about an axis extending in the first direction. The adjustment screw 7 is disposed at a position below the bottom wall of the main body cover 20 and frontward of the first slider 39 and second slider 49. The adjustment screw 7 has a length D1 (FIGS. 6 and 7) in the first direction that is smaller than a remotest distance D2 (FIG. 3) between the first support portion 30 and the second support portion 40 in the leftward/rightward direction. Specifically, the remotest distance D2 is a distance in the first direction defined between the first support portion 30 and second support portion 40 in a state where the first support portion 30 and second support portion 40 are remotest from each other.

The handle 8 is fixed to a left end portion of the adjustment screw 7. The handle 8 is therefore rotatable together with the adjustment screw 7 about the axis thereof extending in the first direction. The handle 8 is positioned outside of a region RR defined between the first support portion 30 and the second support portion 40 in the first direction when the first support portion 30 and second support portion 40 are positioned remotest from each other (see FIG. 3). The handle 8 is a generally circular disc-shaped wheel having an outer peripheral surface 80 formed with indentation, i.e., a plurality of convex portions 81 and concave portions 82.

As illustrated in FIGS. 3 and 4, the handle 8 is arranged rightward of the recessed portion 28 formed at the front end portion of the left side wall 24 of the main body cover 20. As illustrated in FIG. 6, the outer peripheral surface 80 of the handle 8 has the plurality of convex portions 81 protruding radially outwardly, and the plurality of concave portions 82 concaved radially inwardly. Here, a radial direction of the handle 8 is a direction from a center of the handle 8 toward the outer peripheral surface 80. Specifically, the handle 8 has a generally regular decagonal shape whose each side is recessed into generally V-shape, as illustrated in FIG. 7. Hence, ten sets of the convex portion 81 and the concave portion 82 are provided in the handle 8.

Incidentally, the handle 8 may be a bar-like member extending from the adjustment screw 7, rather than a disc-shaped wheel.

The handle 8 has an upper end positioned above the bottom wall of the main body cover 20, and a lower end positioned below the bottom wall of the main body cover 20. Among the ten sets of the convex portion 81 and the concave portion 82, at least one set of the convex portion 81 and the concave portion 82 is positioned above the bottom wall of the main body cover 20. The upper end of the handle 8 is positioned below an upper end of the main body cover 20 (see FIG. 4).

The handle 8 and other components provide the following positional relationship with respect to the first direction in the state where the first support portion 30 and the second support portion 40 are positioned remotest from each other. Here, referring to FIG. 3, the handle 8 extends in the first direction to have an extending range R2 (axial length) thereof. Here, the extending range R2 denotes a length of the handle 8 in the leftward/rightward direction and is located within a movable range of the handle 8 in the leftward/rightward direction. The extending range R2 of the handle 8 is partly overlapped with an extending range R3 (thickness) of the first support portion 30 in the first direction. The extending range R2 of the handle 8 is smaller than the extending range R3 of the first support portion 30. The extending range R2 of the handle 8 is positioned within the extending range R3 of the first support portion 30 in the first direction.

The protruding portion 36 of the first support portion 30 is positioned adjacent to the handle 8 in the first direction. The extending range R2 of the handle 8 and the extending range R3 of the first support portion 30 are positioned outward of the extending range R1 of the opening 16 in the first direction. That is, the handle 8 is positioned outside of a conveying passage of the printing medium. A part of the extending range R2 of the handle 8 is overlapped with an extending range (thickness) of the left side wall 24 of the main body cover 20 (see FIGS. 4 and 10).

Figure 8:
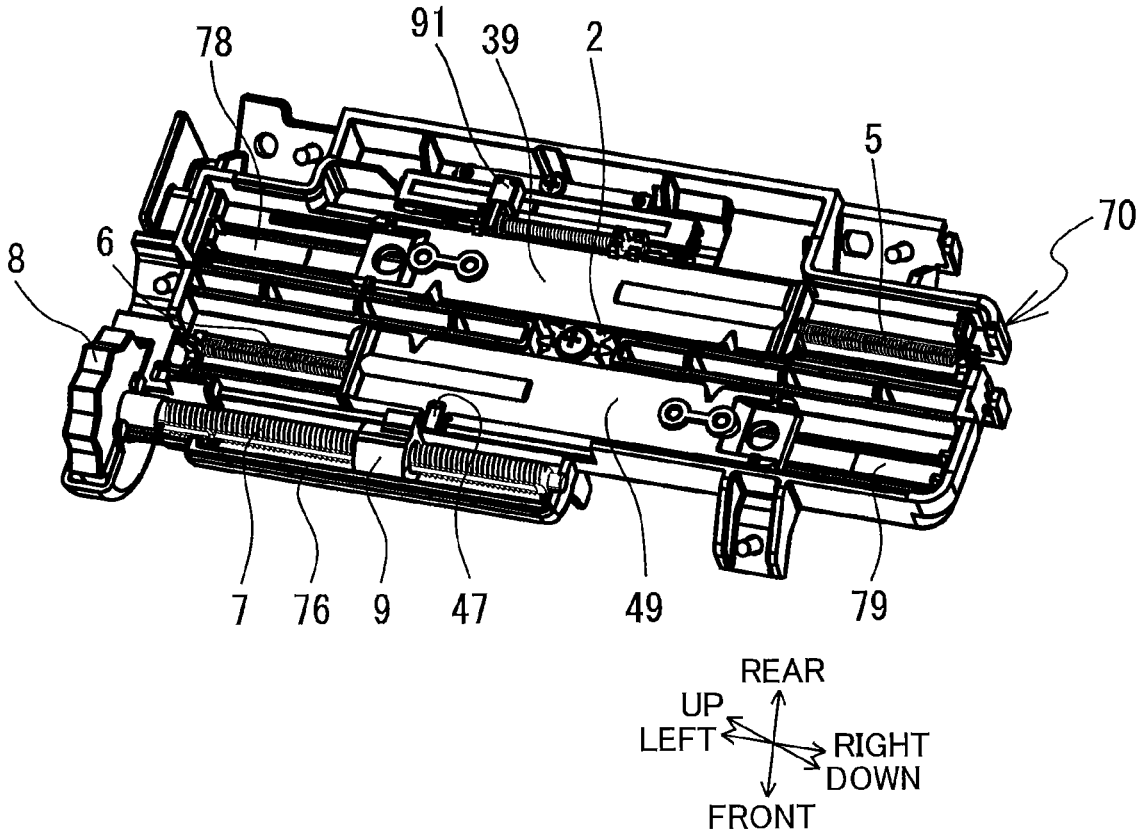
FIG. 8 is a perspective view illustrating a first slider, a second slider, a pinion, springs, the adjustment screw, the handle, and a stopper those positioned in a support plate portion in the printing device according to the embodiment.
Figure 9:
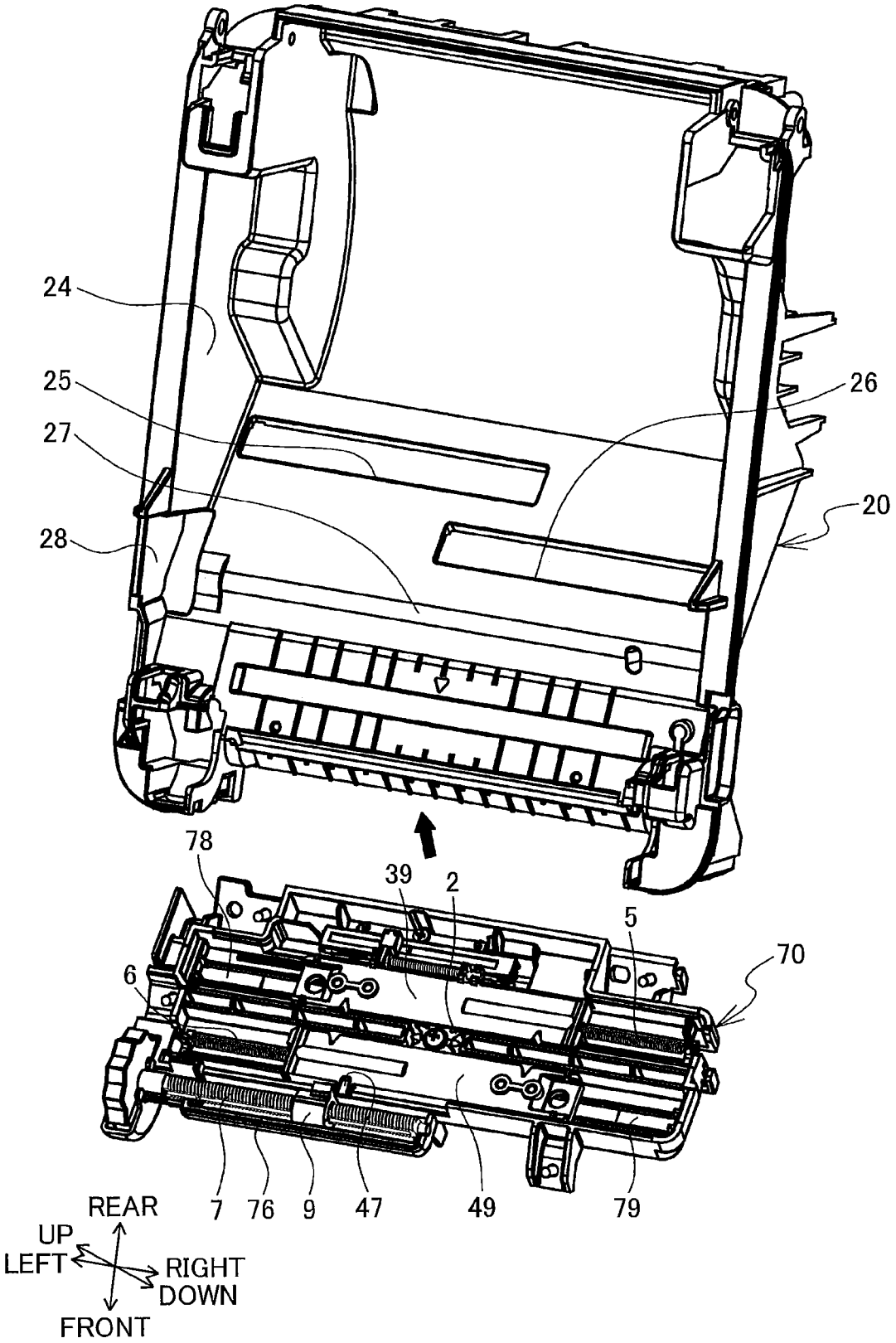
FIG. 9 is a view for description of a process for attaching the support plate portion to the main body cover in the printing device according to the embodiment.

The stopper 9 is threadingly engaged with the adjustment screw 7. The adjustment screw 7 threadingly engaged with the detector 90 is received in the groove 76. The stopper 9 is movable in the first direction by the rotation of the adjustment screw 7 in accordance with the rotating operation to the handle 8. As illustrated in FIGS. 8 and 9, the stopper 9 is configured to abut against a left side surface of the protrusion 47 of the second slider 49. Hence, further leftward movement of the second movable member 4 by an urging force of the spring 6 can be restricted, and hence, further movement of the first movable portion 3 is also restricted. As an alternative example, the stopper 9 may be configured to abut against a right side surface of a protrusion which may be provided in the first slider 39. Hence, further rightward movement of the first movable member 3 can be restricted. That is, the stopper 9 may be configured to abut against either one of the first slider 39 and second slider 49 to restrict movement of the first movable portion 3 and second movable portion 4 in the first direction.

The detector 90 is configured to detect a width of the sheet roll M supported by the holder 23. The width of the sheet roll M is an extending length in the leftward/rightward direction (first direction) of the core tube of the sheet roll M. The detector 90 is a conventional variable resistor or potentiometer provided for detecting a position in the first direction of a movable probe 91. The movable probe 91 is movable integrally with the first slider 39. The detector 90 detects the width of the sheet roll M by detecting the position of the first support portion 30 in the first direction based on the position in the first direction of the movable probe 91.

3. Operations to the Holder 23

Next, how the holder 23 is operated for setting the printing medium will be described with reference to FIGS. 2 and 3. In order to set or accommodate the sheet roll M in the accommodating portion 21 of the printing device 1, or in order to detach the sheet roll M from the accommodating portion 21, a user operates the roll holder 23. Here a process for accommodating the sheet roll M in the accommodating portion 21 will be described, as an example of the operations to the holder 23.

First, the user opens the cover 12 of the printing device 1. With the cover being open, the user catches one of the recessed portion 35 of the first support portion 35 and the recessed portion 45 of the second support portion 45 with his or her finger (or with using an operation piece), and moves the one of the first support portion 35 and the second support portion 45 in the direction to be separated away from each other (outward in the leftward/rightward direction). Then, the user puts the sheet roll M in a space between the first support portion 30 and the second support portion 40. At this time, the sheet roll M is so set that a sheet winding direction thereof is coincident with a clockwise direction in a right side view.

The user then releases the first support portion 30 or the second support portion 40, so that the first support portion 30 and the second support portion 40 move toward each other by the urging forces of the springs 5 and 6 until the sector portions 32 and 42 are respectively brought into contact with widthwise ends of the sheet roll M. Upon abutment of the sector portions 32 and 42 with the sheet roll M, the first support portion 30 and the second support portion 40 stop moving inward, and the protrusions 31 and 41 are respectively fitted with holes at both widthwise ends of the core tube of the sheet roll M. Hence, a distance between the sector portions 32 and 42 is approximately equal to a widthwise length of the sheet roll M.

Further, the detector 80 becomes capable of outputting a value indicative of the position of the first support portion 30 in the first direction. The printing medium pulled out (unwound) from the sheet roll M is positioned along a curvature of the bottom wall of the main body cover 20. A leading end of the printing medium is positioned adjacent to the discharge portion 15. The widthwise edges of the printing medium are guided by the convex portions 36 and 46, respectively. The conveying passage for the printing medium is thus defined. The user then closes the cover 12.

Instead of the sheet roll M, a printing medium positioned outside of the housing 10 may be fed into the housing 10 of the printing device 1 through the opening 16. Next, a process for feeding the printing medium positioned outside of the housing 10 into a position between the first support portion 30 and second support portion 40 inside the housing 10 through the opening 16 will be described. That is, the process includes inserting the printing medium through the opening 16, and positioning the printing medium between the first support portion 30 and the second support portion 40 inside the housing 10.

With the cover 12 being open, the user operates the handle 8 to move the position of the stopper 9 in the leftward/rightward direction. The movements of the first movable portion 3 and the second movable portion 4 are restricted due to abutment of the protrusion 47 of the second slider 49 against the stopper 9, thereby providing positioning to the first movable portion 3 and second movable portion 4. That is, the abutment of the protrusion 47 of the second slider 49 against the stopper 9 restricts further movement of the second movable portion 4, which in turn restricts further movement of the first movable portion 3 with regard to the first direction, since the first movable portion 3 is interlockingly movable with the second movable portion 4 through the pinion 2.

As a provisional adjustment, the user operates the handle 8 so as to set the distance between the first support member 30 and the second support member 40 slightly greater than the width of the printing medium. Then, the printing medium positioned outside of the housing 10 is introduced, through the opening 16, into a portion between the first support portion 30 and the second support portion 40 inside the housing 10. The user again operates the handle 8 to move the stopper 9 for adjusting the distance between the first support portion 30 and the second support portion 40 to be coincident with the width of the printing medium. The printing medium is then disposed along the curvature of the bottom wall of the main body cover 20, and a leading end of the printing medium is positioned adjacent to the discharge portion 15. Both widthwise edges of the printing medium are guided by the convex portions 36 and 46. The conveying passage for the printing medium is thus defined. The user closes the cover 12, thereafter.

4. Printing Operation

In operation, in the closed state of the cover 12, the thermal head 29 presses the printing medium toward the platen roller 22. A conveying motor (not illustrated) is provided for rotating the platen roller 22. Rotation of the platen roller 22 pays out the printing medium from the sheet roll M and conveys the printing medium toward the discharge portion 15. In the thermal head 29, a plurality of heating elements selectively generate heat, to thus print a character image on a line-by-line basis on a heat sensitive layer of the printing medium. The discharge portion 15 ejects the printing medium printed with the image in the interior of the printing device 1 to the outside of the printing device 1. Incidentally, the printing device 1 may be provided with a cutter for cutting the printed tape at a predetermined position.

5. Technical and Operational Advantages

In the printing device 1 according to the above-described embodiment, the adjustment screw 7, the handle 8, and the stopper 9 are provided for regulating the movement of the first movable portion 3 and the second movable portion 4. This structure can realize a compact structure for restricting the movement of the first movable portion 3 and the second movable portion 4, in comparison with a conventional structure where a fixing member is provided at one of the pair of support portions.

In the printing device 1 according to the above-described embodiment, at least part of the extending region R2 of the handle 8 is overlapped with the extending region R3 of the first support portion 30 in the first direction in a state where the first support portion 30 and the second support portion 40 are positioned remotest from each other. Therefore, in the printing device 1 according to the embodiment, a space required for accommodating the structure for regulating the movement of the first movable portion 3 and the second movable portion 4 in the first direction can be reduced in comparison with a conceivable printing device where at least part of the extending region R2 of the handle 8 is not overlapped with the extending region R3 of the first support portion 30 or the second support portion 40 in the first direction.

The printing device 1 according to the above-described embodiment includes the housing 10 accommodating therein the first movable portion 3, the second movable portion 4, the adjustment screw 7, the handle 7, and the stopper 9; and the printing device 1 also has the opening 16 extending in the first direction for allowing insertion of the printing medium positioned outside of the housing 10 into the position between the first support portion 30 and the second support portion 40 positioned inside the housing 10. The extending range R2 of the handle 8 is positioned outside of the extending range R1 of the opening 16 in the first direction.

Therefore, even in a case where an elongated printing medium positioned outside of the housing 10 is inserted through the opening 16 into the position between the first support portion 30 and the second support portion 40, adjustment of the distance between the first support portion 30 and the second support portion 40 can be performed using the handle 8. In other words, the handle 8 is not covered with the printing medium but is exposed to the user even if the printing medium is positioned between the first support portion 30 and the second support portion 40. Consequently, in the printing device 1, operation to the handle 8 can be facilitated in comparison with a printing device where a handle is covered by the printing medium.

The adjustment screw 7 of the printing device 1 has the length D1 in the first direction that is smaller than the distance D2 between the first support portion 30 and the second support portion 40 when the first support portion 30 and the second support portion 40 are positioned remotest from each other. This structure can reduce a space occupied by the adjustment screw 7, in comparison with a printing device where an adjustment screw has a length in the first direction equal to or greater than the remotest distance D2 between the first support portion and the second support portion.

The outer peripheral surface 80 of the handle 8 has a disc-like shape with the outer peripheral surface 80 formed with the plurality of alternating concave and convex portions 81 and 82. Therefore, the user can easily rotate the handle 8 by engaging his/her fingers or the operation piece with the concave and convex portions 81 and 82.

In the printing device 1, only the handle 8 is positioned above the bottom wall of the main body cover 20 among the components for regulating the movement of the first movable portion 3 and the second movable portion 4. Further, the handle 8 is positioned outward of the conveying passage of the printing medium. With this structure, facilitated adjustment of the distance between the first support portion 30 and the second support portion 40 can be realized in the printing device 1 in comparison with a printing device where a position of a handle is overlapped with the conveying passage.

6. Variations and Modifications

While the description has been made in detail with reference to the embodiments thereof, it would be apparent to those skilled in the art that many modifications and variations may be made therein without departing from the scope of the disclosure.

For example, for urging the first movable portion 3 and second movable portion 4 to approach each other, an urging member for urging the pinion 2 may be available, instead of the springs 5, 6 respectively urging the first movable portion 3 and second movable portion 4.

Further, at least part of the extending range R2 of the handle 8 may not be overlapped with the extending range R3 of one of the first support portion 30 and the second support portion 40 in the first direction in the state where the first support portion 30 and the second support portion 40 are positioned remotest from each other. For example, a part or an entirety of the extending range R2 of the handle 8 may be overlapped with the extending range R1 of the opening 16 in the first direction.

The stopper 9 may be brought into abutment with one of the first slider 39 and the second slider 49. For example, the stopper 9 may be brought into contact with the first slider 39, rather than the second slider 49. Further, the adjustment screw 7 may be positioned on the same datum plane on which the first slider 39, the second slider 49 and the pinion 2 are positioned, or may be positioned offset from the datum plane. For example, the adjustment screw 7 may be positioned above or below the first slider 39 and the second slider 49.

The length D1 of the adjustment screw 7 in the first direction may be equal to or greater than the remotest distance D2 between the first support portion 30 and the second support portion 40 defined when the first support portion 30 and the second support portion 40 are positioned remotest from each other. Further, the handle 8 may have different shapes, such as solid cylindrical shape, and polygonal column. Still alternatively, a slip resistant rubber may be provided at the outer peripheral surface 80 of the handle 8.

Remarks

The printing device 1 is an example of a printing device. The holder 23 is an example of a holder. The first movable portion 3 is an example of a first movable portion. The first slider 39 is an example of a first slider. The toothed portion 390 of the first slider 39 is an example of a first rack. The first support portion 30 is an example of a first support portion. The second movable portion 4 is an example of a second movable portion. The second slider 49 is an example of a second slider. The toothed portion 490 of the second slider 49 is an example of a second rack. The second support portion 40 is an example of a second support portion. The pinion 2 is an example of a pinion. The springs 5 and 6 are examples of a spring. The adjustment screw 7 is an example of an adjustment screw. The handle 8 is an example of a handle. The outer peripheral surface 80 is an example of an outer peripheral surface of the handle. The convex portions 81 and concave portions 82 are examples of a plurality of convex portions and a plurality of concave portions, respectively. The stopper 9 is an example of a stopper. The housing 10 is an example of a housing. The opening 16 is an example of an opening. The main body cover 20 is an example of a main body cover. The accommodating portion 21 is an example of an accommodating portion. The guide slot 25 is an example of a first slot. The guide slot 26 is an example of a second slot. The sheet roll M is an example of a sheet roll.

What is claimed is:

1. A printing device comprising a holder configured to hold a printing medium, the holder comprising:

a first movable portion comprising:

a first slider formed with a first rack; and a first support portion connected to the first slider;

a second movable portion comprising:

a second slider formed with a second rack; and a second support portion connected to the second slider and configured to support the printing medium in cooperation with the first support portion;

a pinion in meshing engagement with each of the first rack and the second rack, the first movable portion being movable in a first direction and in a second direction opposite to the first direction, the second movable portion being movable in the first direction in accordance with movement of the first movable portion in the second direction, and the second movable portion being movable in the second direction in accordance with movement of the first movable portion in the first direction;

a spring configured to apply an urging force such that the first movable portion and the second movable portion approach each other;

an adjustment screw extending in the first direction and rotatable about an axis extending in the first direction;

a handle rotatable together with the adjustment screw about the axis, the handle being positioned outside of a region defined between the first support portion and the second support portion in the first direction in a state where the first support portion and the second support portion are positioned remotest from each other; and a stopper threadingly engaged with the adjustment screw and movable in the first direction and in the second direction in accordance with rotation of the adjustment screw caused by rotational operation to the handle, the stopper being configured to abut against one of the first movable portion and the second movable portion to restrict movements of the first movable portion and the second movable portion.

2. The printing device according to claim 1, wherein the spring urges the first movable portion.

3. The printing device according to claim 1, wherein the spring urges the second movable portion.

4. The printing device according to claim 1, wherein the spring urges the pinion.

5. The printing device according to claim 1, wherein the second slider comprises a protrusion in abutment with the stopper.

6. The printing device according to claim 1, wherein the handle is a disc-shaped wheel.

7. The printing device according to claim 1, wherein the handle has an extending range in the first direction, and wherein one of the first support portion and the second support portion has an extending range in the first direction, at least a part of the extending range of the handle being overlapped with the extending range of the one of the first support portion and the second support portion in the first direction in the state where the first support portion and the second support portion are positioned remotest from each other.

8. The printing device according to claim 7, further comprising a housing accommodating therein the first movable portion, the second movable portion, the adjustment screw, the handle, and the stopper, wherein the housing is formed with an opening extending in the first direction for allowing insertion of the printing medium positioned outside of the housing into a position between the first support portion and the second support portion, and wherein the opening has an extending range in the first direction, the extending range of the handle being positioned outside of the extending range of the opening in the first direction.

9. The printing device according to claim 1, wherein the adjustment screw has a length in the first direction, the length being smaller than a distance defined between the first support portion and the second support portion in the first direction in the state where the first support portion and the second support portion are positioned remotest from each other.

10. The printing device according to claim 1, wherein the handle has a disc shape whose outer peripheral surface is formed with a plurality of convex portions and a plurality of concave portions, each of the plurality of convex portions extending in the first direction and each of the plurality of concave portions extending in the first direction.

11. The printing device according to claim 1, further comprising a housing accommodating the holder therein, the housing comprising:

a main body portion accommodating the first movable portion, the second movable portion, the adjustment screw, the handle, and the stopper; and a cover pivotably movably supported by the main body portion, wherein the main body portion is formed with an opening for allowing insertion of the printing medium positioned outside of the housing into a position between the first support portion and the second support portion.

12. The printing device according to claim 1, further comprising a housing accommodating the holder therein, wherein the housing comprises a main body cover defining an accommodating portion for accommodating a sheet roll therein as the printing medium.

13. The printing device according to claim 12, wherein the main body cover has a bottom wall defining a bottom of the accommodating portion, wherein the pinion, the first slider, the second slider, the spring, the adjustment screw and the stopper are disposed below the bottom wall of the main body cover, and wherein the handle has a portion positioned above the bottom wall of the main body cover.

14. The printing device according to claim 13, wherein the sheet roll has a width in the first direction, the sheet roll comprising a core tube and a sheet wound around the core tube, the sheet unwound from the core tube being configured to be conveyed along a conveying passage over the bottom wall, and wherein the portion of the handle is positioned outside of the conveying passage in the first direction.

15. The printing device according to claim 13, wherein the bottom wall of the main body cover is formed with a first slot and a second slot, the first support portion having a portion connected to the first slider through the first slot, the second support portion having a portion connected to the second slider through the second slot, and wherein the first support portion and the second support portion are configured to detachably support the sheet roll.

* * * * *